US007938590B2

(12) United States Patent
Supron et al.

(10) Patent No.: US 7,938,590 B2
(45) Date of Patent: May 10, 2011

(54) METHODS AND APPARATUS FOR PRINTING RECEIPTS AND VALIDATING FORMS

(75) Inventors: Steven A. Supron, Ithaca, NY (US); David E. Weeks, Willseyville, NY (US); Bruce Harris, Freeville, NY (US); Jeffrey S. Koepele, Ithaca, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 715 days.

(21) Appl. No.: 11/985,332

(22) Filed: Nov. 13, 2007

(65) Prior Publication Data

US 2009/0120313 A1 May 14, 2009

(51) Int. Cl.
*B41J 11/48* (2006.01)

(52) U.S. Cl. ..... 400/607; 400/605; 400/599

(58) Field of Classification Search ..... 400/599, 400/605, 607

See application file for complete search history.

(56) References Cited

U.S. PATENT DOCUMENTS

| | | | | |
|---|---|---|---|---|
| 4,205,770 | A | 6/1980 | Wojdyla | |
| 4,229,113 | A * | 10/1980 | Anderson et al. | 400/596 |
| 5,061,095 | A | 10/1991 | Asai et al. | |
| 5,472,287 | A | 12/1995 | Hasegawa et al. | |
| 5,651,624 | A | 7/1997 | Passer | |
| 6,237,870 | B1 * | 5/2001 | Kawamura | 242/533 |
| 6,443,645 | B1 | 9/2002 | Takei et al. | |
| 6,629,796 | B2 * | 10/2003 | Kawakami et al. | 400/582 |
| 2006/0255528 | A1 * | 11/2006 | Okada et al. | 271/121 |
| 2008/0048393 | A1 * | 2/2008 | Giacometto et al. | 271/265.03 |

FOREIGN PATENT DOCUMENTS

| | | | |
|---|---|---|---|
| DE | 100 46 377 | | 4/2002 |
| JP | 56060280 A | * | 5/1981 |
| JP | 61202869 A | * | 9/1986 |
| JP | 61202870 A | * | 9/1986 |

OTHER PUBLICATIONS

Addmaster Corporation, IJ6080 Specifications Sheet (2 pages) (2005).

Pertech Resources, Inc., 5300 Series Inkjet & Impact Printer Specifications Sheet (2 pages) (2006).

TransAct Technologies Incorporated, POSjet 1000 Specifications Sheet (2 pages) (2006).

TransAct Technologies Incorporated, BANKjet Specifications Sheet (2 pages) (2006).

Epson America, Inc., TM-J7000 & TM-J7100 Specifications Sheet (2 pages) (2004).

Press release, "Transact Technologies Expands Bankjet® Printer Line," Nov. 6, 2007, [online], [retrieved on Nov. 8, 2007], Retrieved from the TransAct Technologies Incorporated website using Internet <URL:http://www.shareholder.com/transact-tech/ReleaseDetailcfm?ReleaseID=273485>.

* cited by examiner

*Primary Examiner* — Daniel J Colilla
(74) *Attorney, Agent, or Firm* — Lipsitz & McAllister, LLC

(57) ABSTRACT

A dual-purpose printer for printing receipts and validating forms is provided. The printer comprises a receipt drive roller for driving paper through a receipt path, a dual-purpose roller capable of contacting the drive roller, and a validation idler roller adapted to be brought into and out of engagement with the dual-purpose roller. The receipt path is formed between the receipt drive roller and the dual-purpose roller. A validation path is formed between the validation idler roller and the dual-purpose roller. Rotation of the receipt drive roller in a first direction enables driving of paper through the receipt path. When the validation idler roller is in engagement with the dual-purpose roller, rotation of the dual-purpose roller in the first direction enables discharging of a form from the validation path.

25 Claims, 12 Drawing Sheets

METHODS AND APPARATUS FOR PRINTING RECEIPTS AND VALIDATING FORMS

BACKGROUND OF THE INVENTION

The present invention relates to the field of printing. More specifically, the present invention relates to methods and apparatus for printing receipts and validating forms using a printer having dual-purpose roller shaft.

There are several dual-purpose printers in the prior art capable of both printing receipts and validating forms, such as checks or coupons. Such printers are used, for example, in conjunction with cash registers at grocery stores, convenience stores, and at other point-of-sale applications. Such printers typically have a roll of paper used to print receipts and a separate slot which accepts forms to be validated and which prints validation indicia on such forms (e.g., checks, coupons, vouchers, etc.). The prior art dual-purpose printers typically have a trapped or enclosed receipt paper path that is not easily accessible. Paper in each machine is loaded from the supply roll, under a non-opening drive roller assembly. The paper follows the roller to a vertical path where the paper is printed. If a jam occurs during the loading or during printer operation it can be very difficult to remove the paper.

It would be advantageous to provide a dual-purpose printer that validates inserted forms and prints receipts using a low-cost, compact architecture. It would also be advantageous to provide such a printer with independent drive mechanisms for driving paper through a receipt path for printing receipts and for driving a form out of a validation path after validation and printing of validation indicia thereon. It would be advantageous to provide such a printer with a dual-purpose roller which idles against the receipt drive roller for printing of receipts and which drives a validation drive roller for validation of forms. It would be further advantageous to provide a validation slot that allows for variable form positioning. In addition, it would be advantageous to enable easy access to the drive roller assemblys and the receipt paper path to enable paper jams to be removed quickly.

The methods and apparatus of the present invention provide the foregoing and other advantages.

SUMMARY OF THE INVENTION

The present invention relates to methods and apparatus for printing receipts and validating forms using a dual-purpose printer having a dual-purpose roller shaft.

In an example embodiment of the present invention, a dual-purpose printer for printing receipts and validating forms is provided. The printer comprises a receipt drive roller for driving paper through a receipt path, a dual-purpose roller capable of contacting the drive roller, and a validation idler roller adapted to be brought into and out of engagement with the dual-purpose roller. The receipt path is formed between the receipt drive roller and the dual-purpose roller. A validation path is formed between the validation idler roller and the dual-purpose roller. Rotation of the receipt drive roller in a first direction enables driving of the paper through the receipt path. When the validation idler roller is in engagement with the dual-purpose roller, the rotation of the dual-purpose roller in the first direction enables discharging of a form from the validation path when validation is completed.

The dual-purpose printer may also include a receipt cover. The receipt drive roller may pivot with the receipt cover. A receipt drive frame may be affixed to the cover. The receipt drive roller may float in the receipt drive frame. For example, the receipt drive frame may permit movement of the receipt drive roller in a radial arc about a pitch line of a corresponding drive gear.

At least one gear train for driving the receipt drive roller may be provided on at least one corresponding side of the receipt drive frame. For example, duplicate gear trains for driving the receipt drive roller may be provided on opposing sides of the receipt drive frame.

Similarly, at least one gear train may be provided for driving the dual-purpose roller. In addition, separate drive motors may be provided for the receipt drive roller and the dual-purpose roller.

The dual-purpose roller may comprise a center idler segment which opposes a center drive segment of the receipt drive roller and two outer drive segments on either side of the center idler segment. The center idler segment may be adapted to idle against the receipt drive roller when in contact with the receipt drive roller. The outer drive segments may be adapted to engage corresponding segments of the validation idler roller when the validation idler roller is brought into engagement with the dual-purpose roller.

The dual-purpose printer may also include a print station having a print head. A print carriage may be mounted to the print station.

The validation idler roller may be mounted in the print station. For example, the validation idler roller may be mounted in slide bearings in the print station. The print station may be adapted for pivotable movement enabling the validation idler roller to be brought into and out of engagement with the dual-purpose roller.

A validation lift assembly may be provided for moving the print station between an open and a closed position. In the open position the validation idler roller may be out of engagement with the dual-purpose roller. In the closed position the validation idler roller may be in engagement with the dual-purpose roller. At least one sensor may be provided for sensing the open and the closed positions.

The validation lift assembly may comprise a compact DC motor, a worm gear reduction unit, and a disk cam. The disk cam may be adapted to engage an underside of the print station or a secondary bearing plate. An upper surface of the cam may be profiled for pivoting the print station between the open position and the closed position.

The form may comprise a check, a voucher, a ticket, a coupon, or the like. A validation slot may be provided in the validation paper path for accepting the form. The validation slot may extend through a body of the printer enabling validation of forms that are larger than a width of the printer.

An adjustable slip stop may be provided for variable positioning of the form in a validation slot of the validation path. The slip stop may be retractable, enabling the slip stop to be moved into and out of the validation slot and the validation path.

The present invention also includes methods for printing receipts and validating forms which correspond to the dual-purpose printer described above. In one example method embodiment, a receipt path is provided between a receipt drive roller and a dual-purpose roller and a validation path is provided between a validation idler roller and the dual-purpose roller. The receipt drive roller is enabled to rotate in a first direction for driving of paper through the receipt path. The validation idler roller is adapted to be brought into and out of engagement with the dual-purpose roller. The dual-purpose roller is enabled to rotate in the first direction when the validation idler roller is brought into engagement with the dual-purpose roller for driving a form out of said validation path after validation is complete.

The methods may also include additional features discussed above in connection with the dual-purpose printer embodiments.

BRIEF DESCRIPTION OF THE DRAWINGS

The present invention will hereinafter be described in conjunction with the appended drawing figures, wherein like reference numerals denote like elements, and:

FIG. 9A-9C shows the slip stop in a different position.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

The present invention relates to methods and apparatus for printing receipts and validating forms using a dual-purpose roller shaft.

Figure 1:
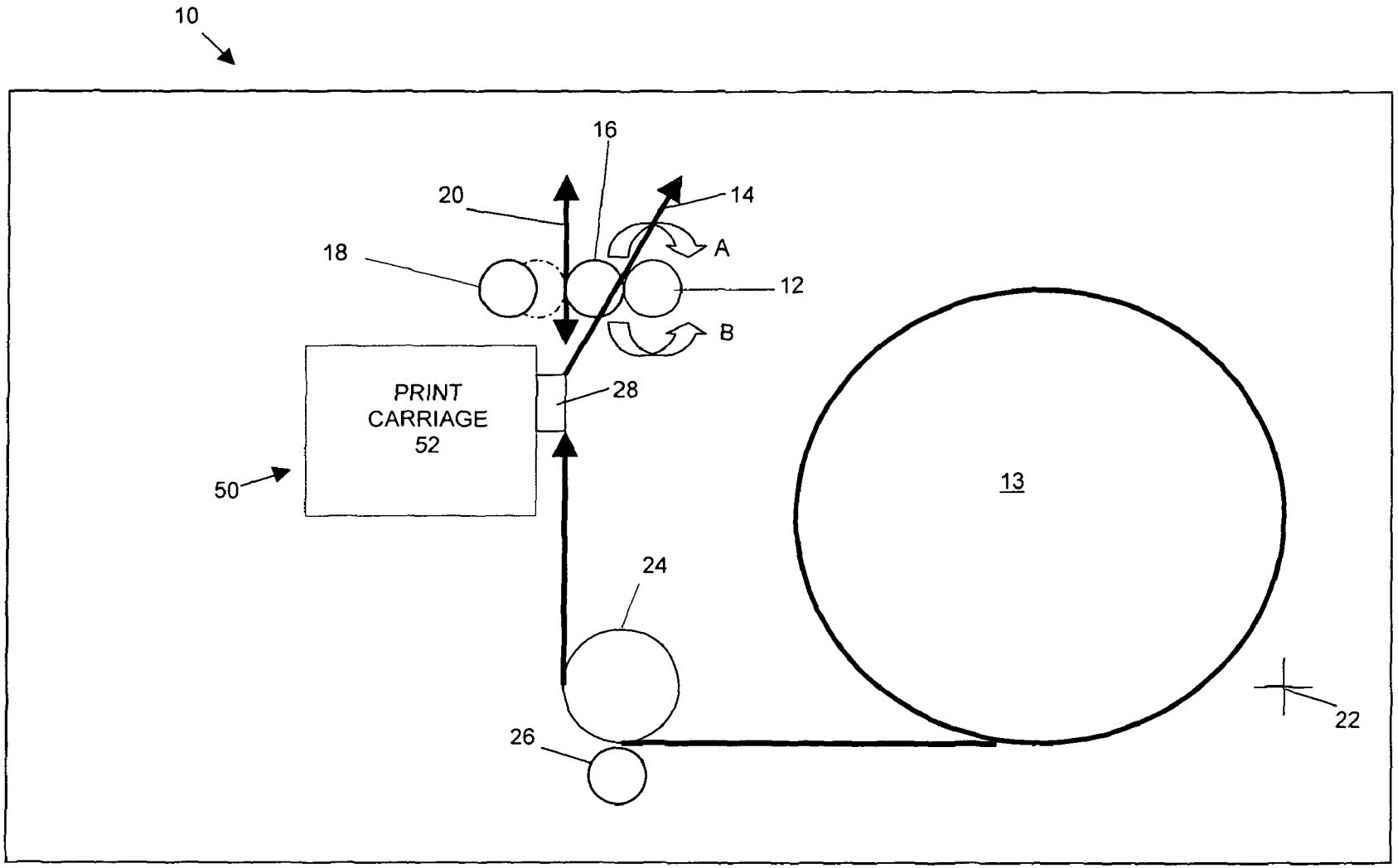
FIG. 1 shows a simplified block diagram of an example embodiment of the present invention.

In an example embodiment of the present invention as shown in FIG. 1, a dual-purpose printer 10 for printing receipts and validating forms is provided. The printer 10 comprises a receipt drive roller 12 for driving paper 13 through a receipt path 14, a dual-purpose roller 16 capable of contacting the drive roller 12, and a validation idler roller 18 adapted to be brought into and out of engagement with the dual-purpose roller 16. In FIG. 1, the validation idler roller 18 is shown in solid lines when out of engagement with the dual-purpose roller 16 and in dashed lines when engaged with dual-purpose roller 16. The receipt path 14 is formed between the receipt drive roller 12 and the dual-purpose roller 16. A validation path 20 is formed between the validation idler roller 18 and the dual-purpose roller 16. The receipt drive roller 12 is adapted for rotation in a first direction (shown by arrow A) and an opposite second direction (shown by arrow B). The rotation of the receipt drive roller 12 in the first direction A enables driving of the paper 13 through the receipt path 14.

It should be noted that the receipt drive roller 12 is bi-directional as it is necessary in certain printing situations to reverse the drive to print (or complete printing) special characters, high characters, or certain letters such as lower case "y" which fall below a nominal print line.

Figure 3:
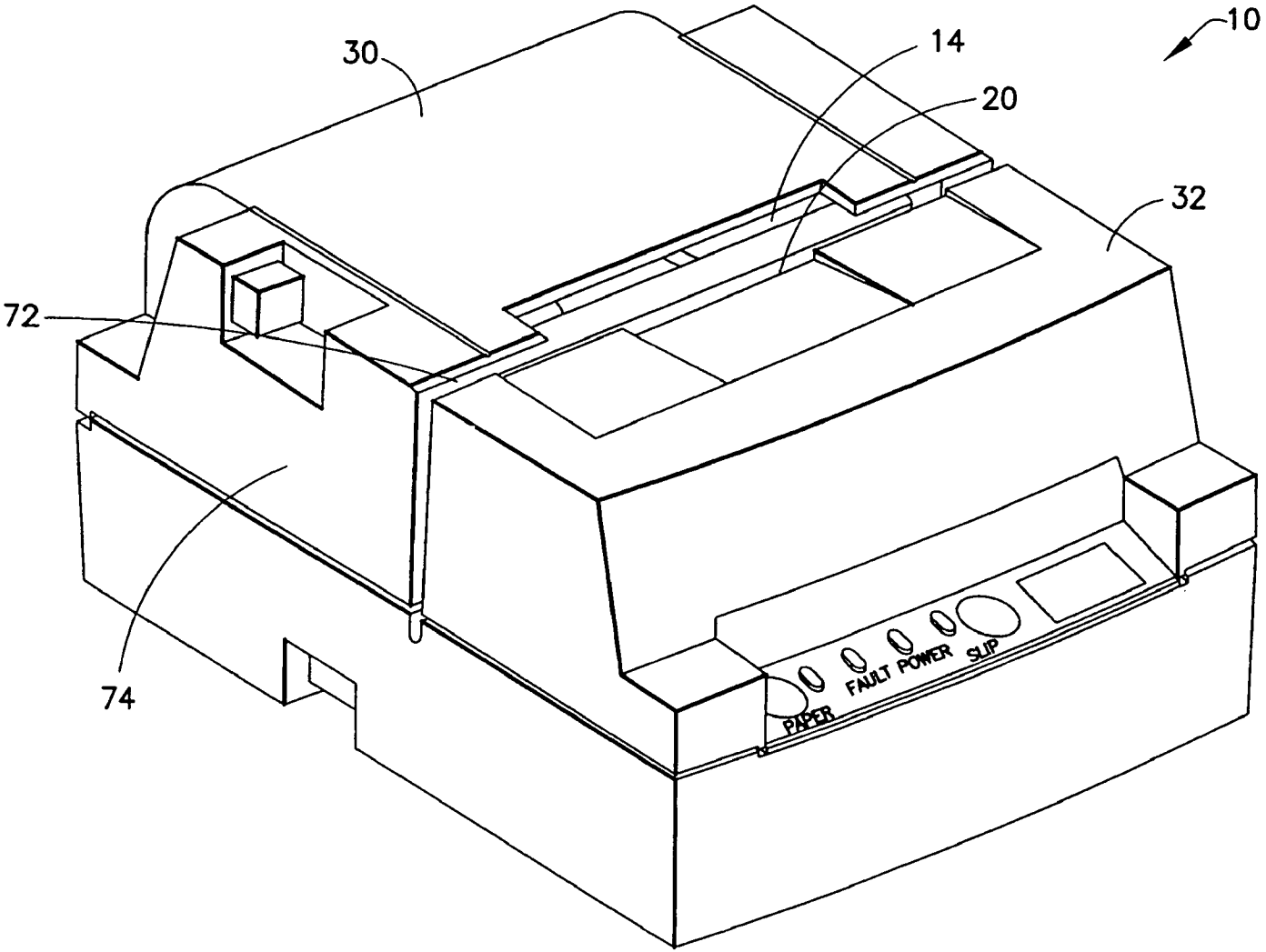
FIG. 3 shows an example embodiment of a dual-purpose printer in accordance with the present invention with the receipt cover closed.

For validation of a form, the form is dropped into the validation path 20 via validation slot 72 (FIG. 3). The validation idler roller 18 is then brought into engagement with the dual-purpose roller 16, and the dual-purpose roller 16 is rotated in the first direction for discharging of the form from the validation path 20 when the validation is completed.

The paper 13 used for receipts may be a paper roll as shown in FIG. 1, for example a 3" diameter paper roll. Although the dual-purpose printer of the present invention is described herein as using a paper roll, those skilled in the art will appreciate that the present invention may be implemented using sheets of paper held in a paper tray instead of a paper roll.

Figure 4:
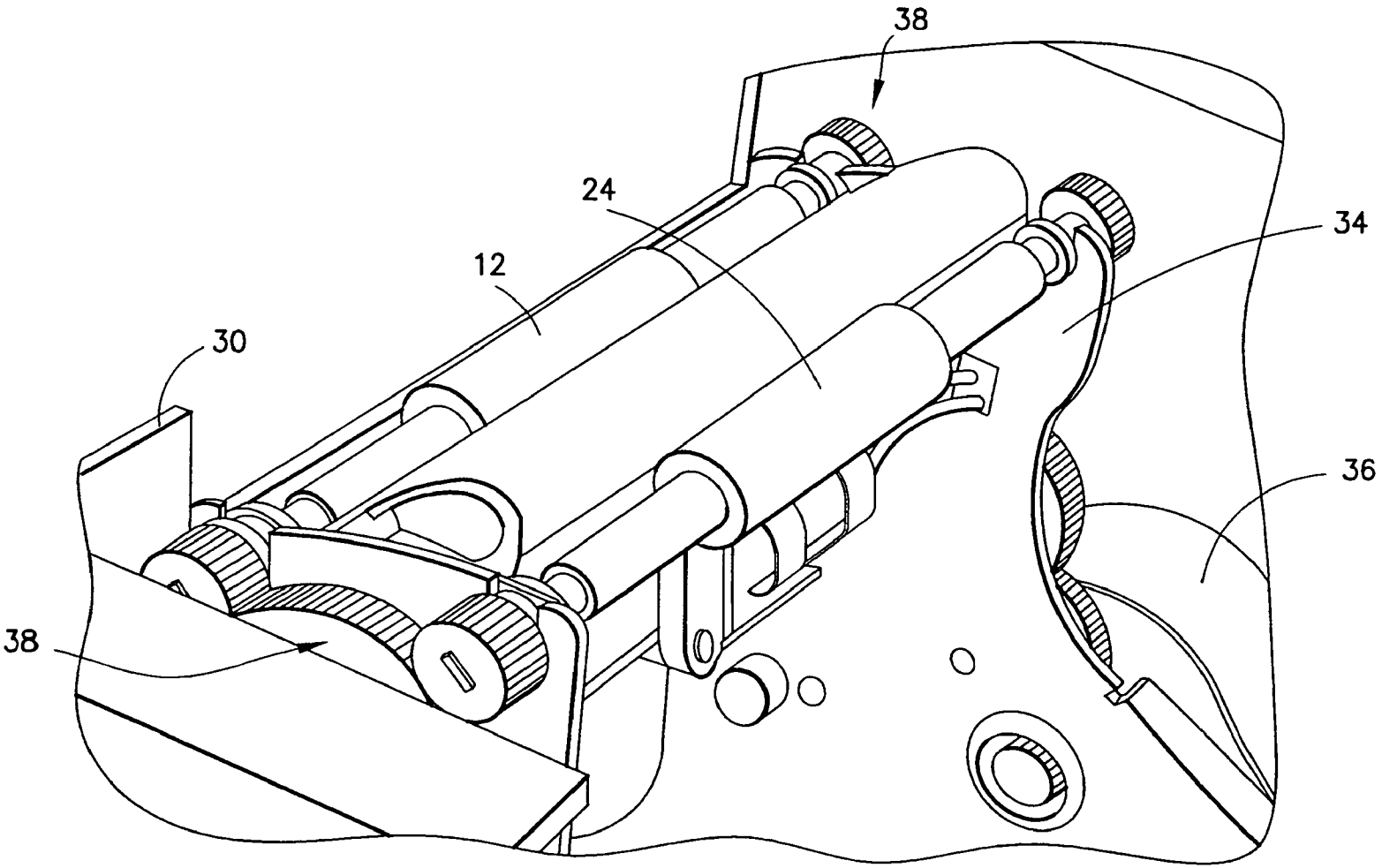
FIG. 4 shows a close up the receipt drive rollers shown in the FIG. 2 example embodiment.
Figure 5:
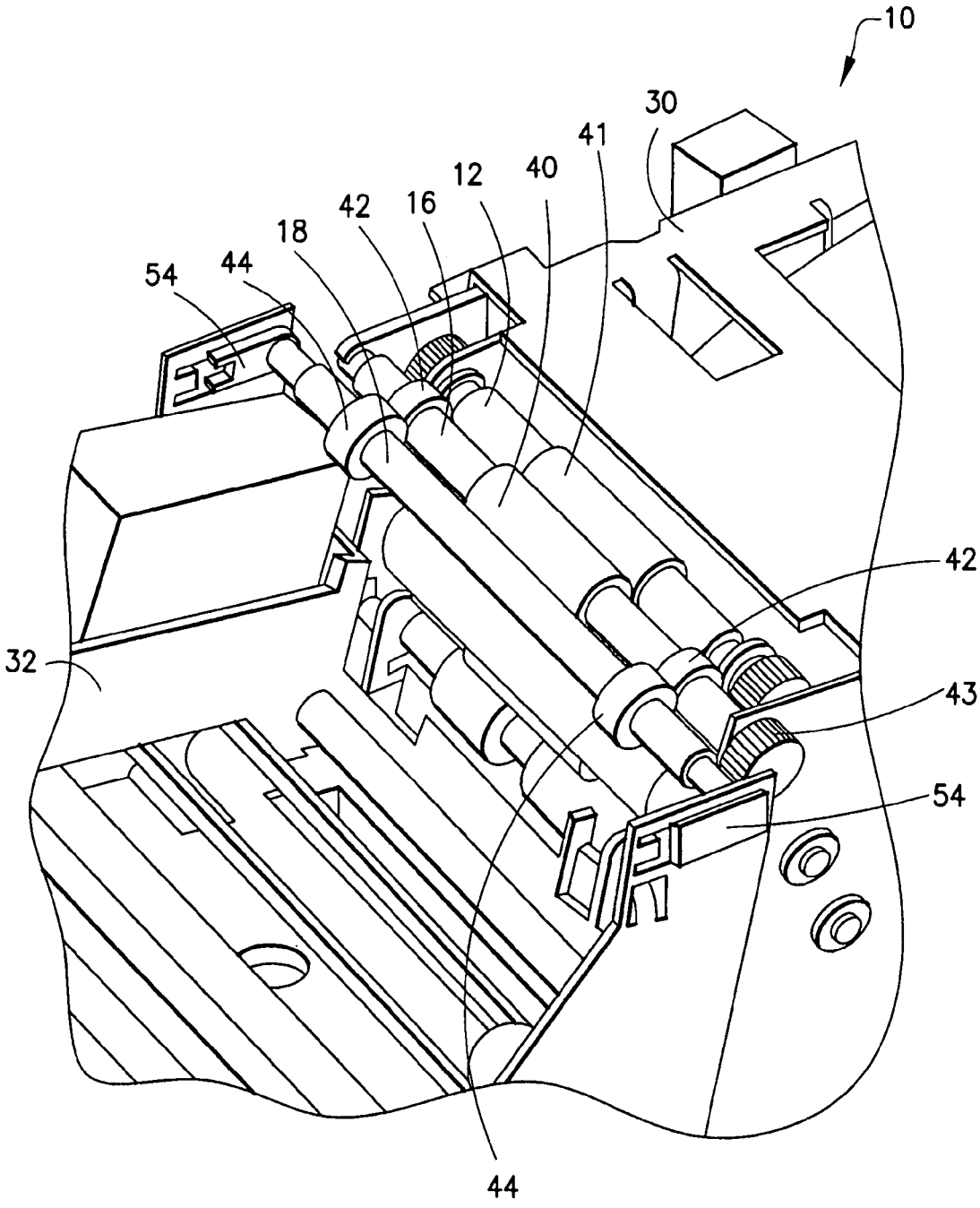
FIG. 5 shows an example embodiment of a dual-purpose printer in accordance with the present invention with the pen cover tilted open.

As shown in FIGS. 2-5, the dual-purpose printer 10 may also include a receipt cover 30 and a pen cover 32. The receipt cover 30 shrouds the receipt paper roll 13. The pen cover 32 shrouds the dual-purpose roller 16 and the validation idler roller 18 (FIG. 5). The receipt drive roller 12 may pivot with the receipt cover 30 as shown in FIG. 1. For example, the cover 30 may pivot from the lower rear position (e.g., about pivot point 22 shown in FIG. 1). When the receipt cover 30 is opened the entire receipt paper path 14 may be exposed to enable quick clearing of paperjams or loading of the receipt paper roll 13.

Figure 2:
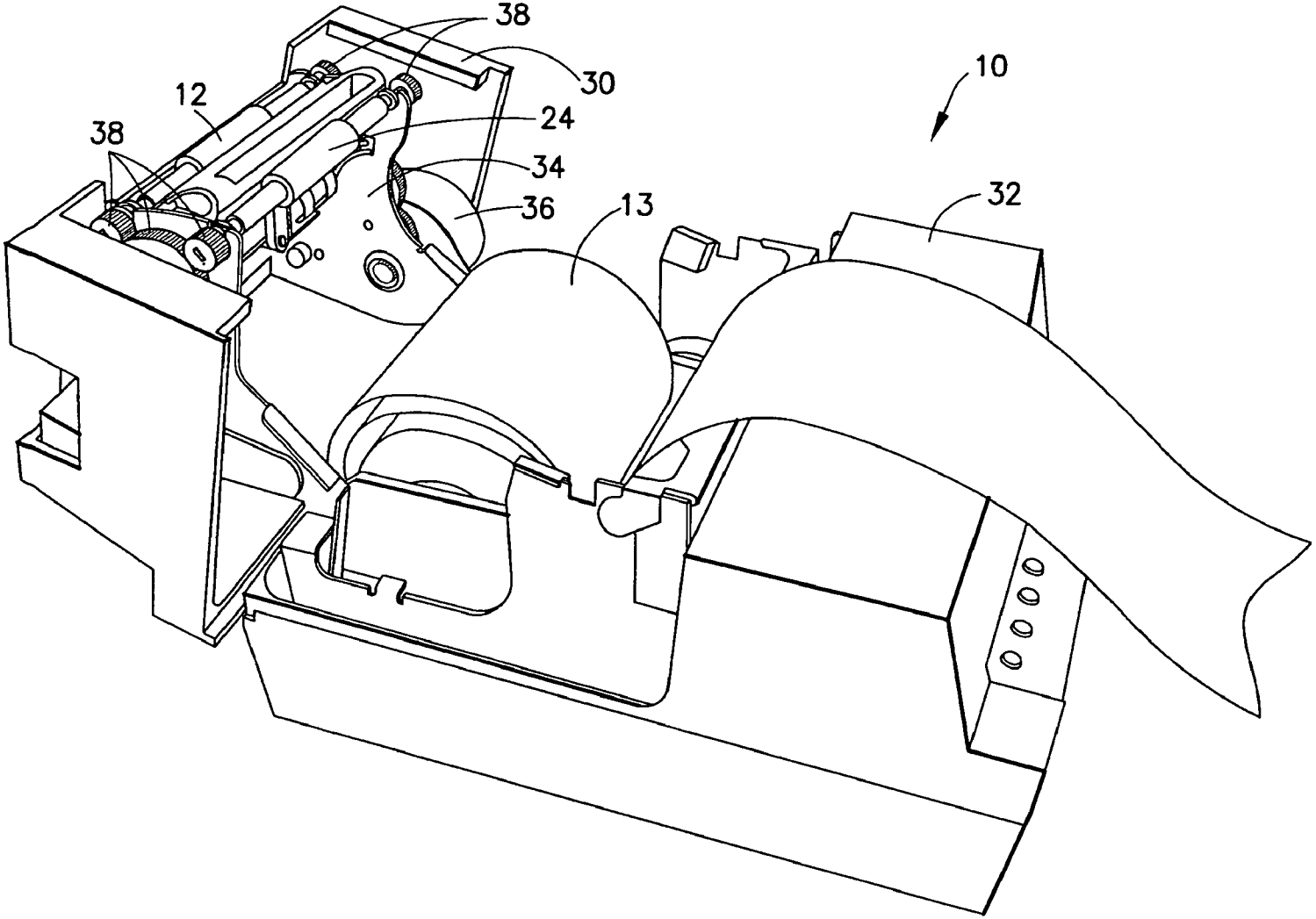
FIG. 2 shows an example embodiment of a dual-purpose printer in accordance with the present invention with the receipt cover tilted open to expose the receipt drive rollers.

As shown in FIGS. 2 and 4, a receipt drive frame 34 may be affixed to the receipt cover 30. The receipt drive frame 34 holds the motor 36 for driving the receipt drive roller 12. The receipt drive roller 12 may float in the receipt drive frame 34. For example, the receipt drive frame 34 may permit movement of the receipt drive roller 12 in a radial arc about a pitch line of a corresponding drive gear. This movement assures that the receipt drive roller 12 maintains contact with the dual purpose roller 16 (when the cover 30 is closed), as the dual-purpose roller 16 may be mounted for rotation in a fixed position on a fixed frame.

At least one gear train 38 for driving the receipt drive roller 12 may be provided on at least one corresponding side of the receipt drive frame 34. For example, duplicate gear trains 38 for driving the receipt drive roller 12 may be provided on opposing sides of the receipt drive frame 34. Duplicating the gear train 38 for the receipt drive roller 12 on each side of the frame 34 balances the reactive forces of the gear mesh. Thus, the receipt drive roller 12 is able to compensate for manufacturing tolerances and variability so that it reliably engages with the center of the dual-purpose roller 16.

A lower receipt drive roller 24 may also be provided. This lower receipt drive roller 24 may also pivot with the receipt cover 30. The lower receipt drive roller 24 may be opposed by a spring-loaded idler roller 26 (FIG. 1). As shown in FIG. 1, the receipt path 14 may travel from the receipt paper roll 13, between the lower receipt drive roller 24 and the spring loaded idler roller 26, past a print head 28, and between the dual-purpose roller 16 and the receipt drive roller 12.

As shown in FIG. 5, the dual-purpose roller 16 may comprise a center idler segment 40 which opposes a center drive segment 41 of the receipt drive roller 12 as well as two outer drive segments 42 on either side of the center idler segment 40. The center idler segment 40 may be adapted to idle against the center drive segment 41 of the receipt drive roller 12 when in contact with the receipt drive roller 12. The outer drive segments 42 may be adapted to engage corresponding segments 44 of the validation idler roller 18 when the validation idler roller 18 is brought into engagement with the dual-purpose roller 16. The outer drive segments 42 may comprise bonded rubber drive elements which straddle the receipt path 16 as shown in FIG. 5, so as not to influence the receipt drive roller 12 during printing of receipts.

Figure 10:
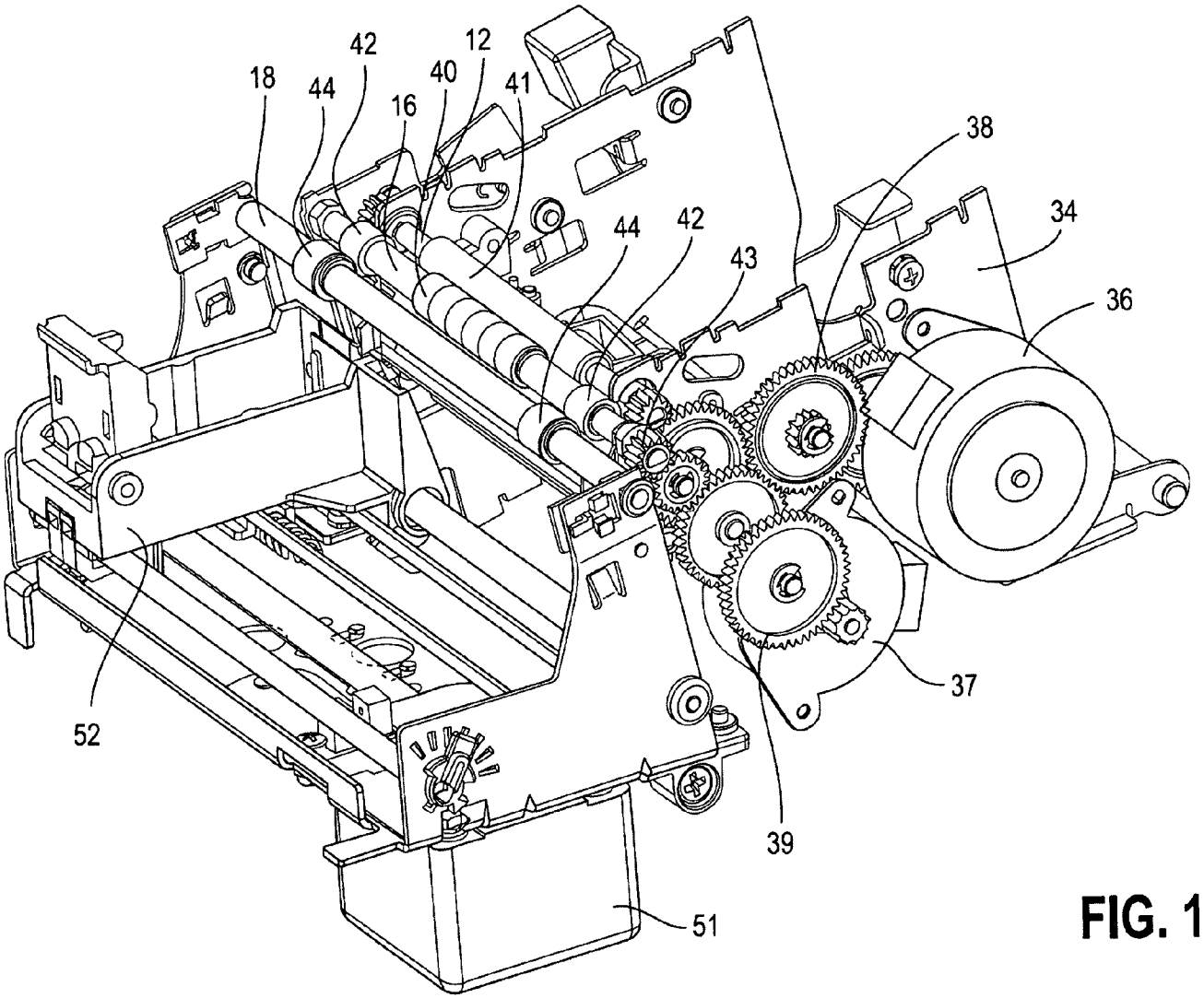
FIG. 10 shows a further example embodiment of a dual-purpose printer having separate drive motors for the receipt drive roller and the dual-purpose roller.

As shown in FIG. 10, at least one gear train 39 may be provided for driving the dual-purpose roller 16 (similar to the gear train 38 discussed above in connection with the receipt drive roller 12). For example, gear 43 connected to the dual-purpose roller 16 may be connected to a separate drive motor 37 via a separate gear train 39 for driving the dual-purpose roller 16. When driven, the outer drive segments 42 of the dual-purpose roller 16 drive the validation idler roller 18 via corresponding segments 44 on the validation idler roller 18.

Figure 6:
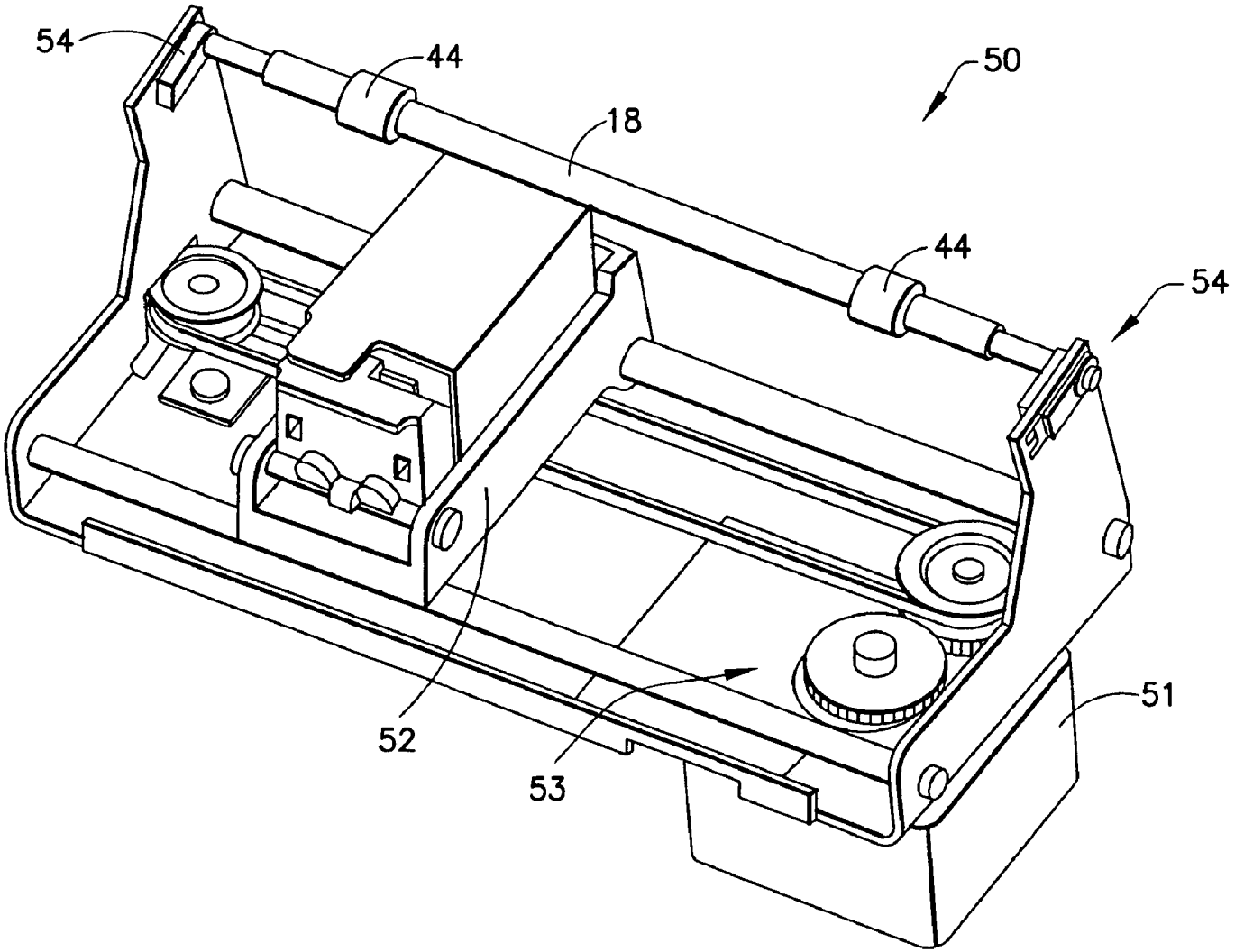
FIG. 6 shows an example embodiment of a print station in accordance with the present invention.

As shown in FIGS. 1 and 6, the dual-purpose printer 10 may also include a print station 50 having a print head 28. The print head 28 may be carried by a print carriage 52. The print carriage 52 may be mounted to the print station 50. The print head 28 is used to both print receipts and to print validation indicia on forms to be validated. As shown in FIG. 1, the receipt path 14 and the validation path 20 both travel in front of the print head 28. The print carriage 52 is driven back and forth across a print field of the receipt path 14 and validation path 20 in a conventional manner by motor 51 and carriage drive 53.

The validation idler roller 18 may be mounted in the print station 50. For example, the validation idler roller 18 may be mounted in slide bearings 54 in the print station. Mounting the validation idler roller 18 in slide bearings 54 compensates for manufacturing tolerances and variability. The print station 50 may be adapted for pivotable movement enabling the validation idler roller 18 to be brought into and out of engagement with the dual-purpose roller 16. When the print station 50 pivots so that the validation idler roller 18 is brought into engagement with the dual-purpose roller 16, it may "over close" by approximately 0.03" to compensate for variability and ensure that the drive segments 42 of the dual-purpose roller 16 are engaged by the corresponding segments 44 of the validation idler roller 18, which helps prevent skew of forms during validation. The print station pivots independently of the pen cover.

Figure 7:
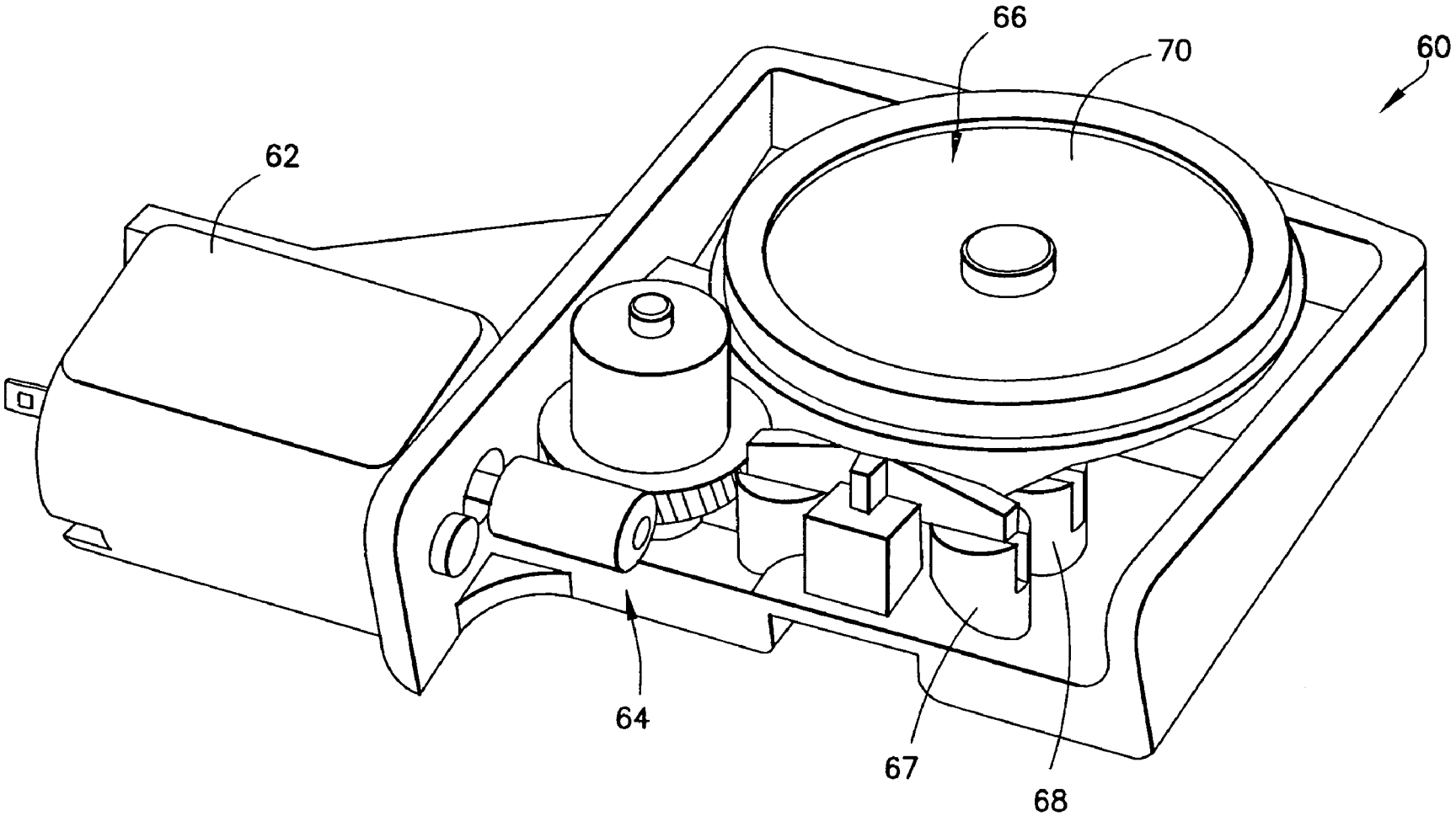
FIG. 7 shows an example embodiment of a validation lift assembly in accordance with the present invention.

As shown in FIG. 7, a validation lift assembly 60 may be provided for moving the print station 50 between an open and a closed position. In the open position the validation idler roller 18 may be out of engagement with the dual-purpose roller 16 to provide an opening or "nip" at the beginning of the validation path 20 for insertion of the form to be validated. In the closed position the validation idler roller 18 may be in engagement with the dual-purpose roller 16 for driving the inserted form out of the validation path 20 after validation and printing of validation indicia thereon. At least one sensor (e.g., sensors 67 and 68 discussed below) may be provided for sensing the open and the closed positions.

The validation lift assembly 60 may be mounted directly beneath the print station 50. The validation lift assembly 60 may comprises a compact DC motor 62, a worm gear reduction unit 64, and a disk cam 66. The underside of the cam 64 may have two tracks which signal one sensor 67 when the print station 50 is fully raised (validation idler roller 18 engaged) and which signal the other sensor 68 when the print station 50 is fully lowered (validation nip opened for insertion). The disk cam 66 may be adapted to engage an underside of the print station 50 (or a secondary bearing plate). For example, the upper surface 70 of the cam 66 may be in direct contact with the underside of the print station 50. A small piece of plastic may be used to reduce friction at this contact point. The upper surface 70 of the cam may be profiled for pivoting the print station 50 between the open position and the closed position.

The form may comprise one of a check, a voucher, a ticket, a coupon, or the like. As shown in FIG. 3, a validation slot 72 may be provided in the validation paper path 20 for accepting the form to be validated. The validation slot 72 may extend through a body 74 of the printer 10 enabling validation of forms that are larger than a width of the printer 10. This configuration enables "Cut Through Validation."

Figure 8:
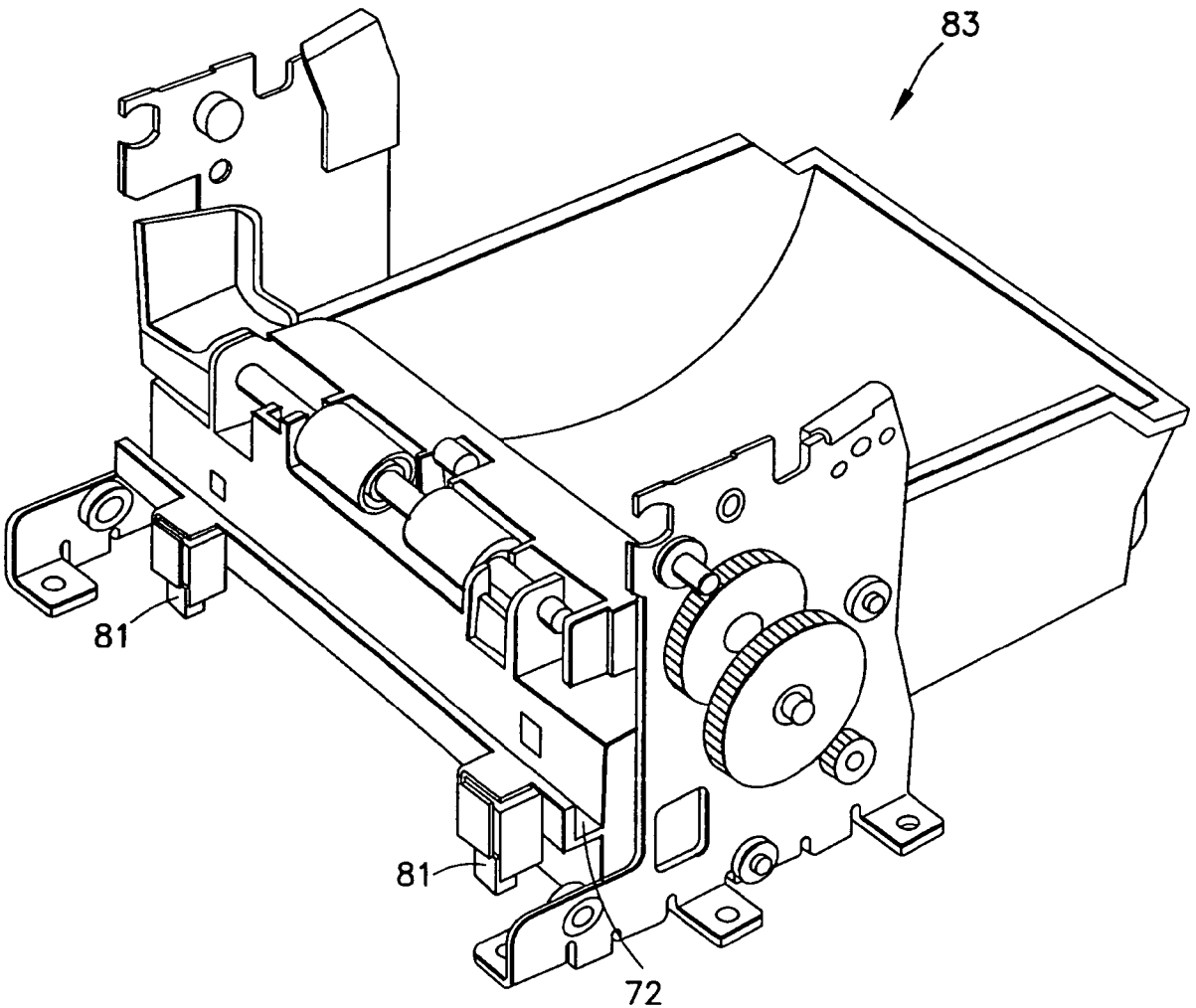
FIG. 8 shows an example embodiment of a paper bucket with validation slot sensors in accordance with an example embodiment of the present invention.

The form to be validated may be dropped into the validation slot 72 and positioned left to right to vary the position of the print zone on the form. The print zone may be defined by the field of movement of the print carriage 52. Two sensors 81 in the paper bucket 83 (FIG. 8) verify the form is inserted into the slot 72 (i.e., when the form is blocking both sensors.) The sensors 81 closely straddle the print zone (which is also defined by the edges of the paper bucket). The sensors 81 verify that the form is positioned in the print zone. If the slip is wide enough, the print position on the form can be varied by sliding the slip left to right, but still covering the sensors 81 straddling the print zone.

Figure 9A:
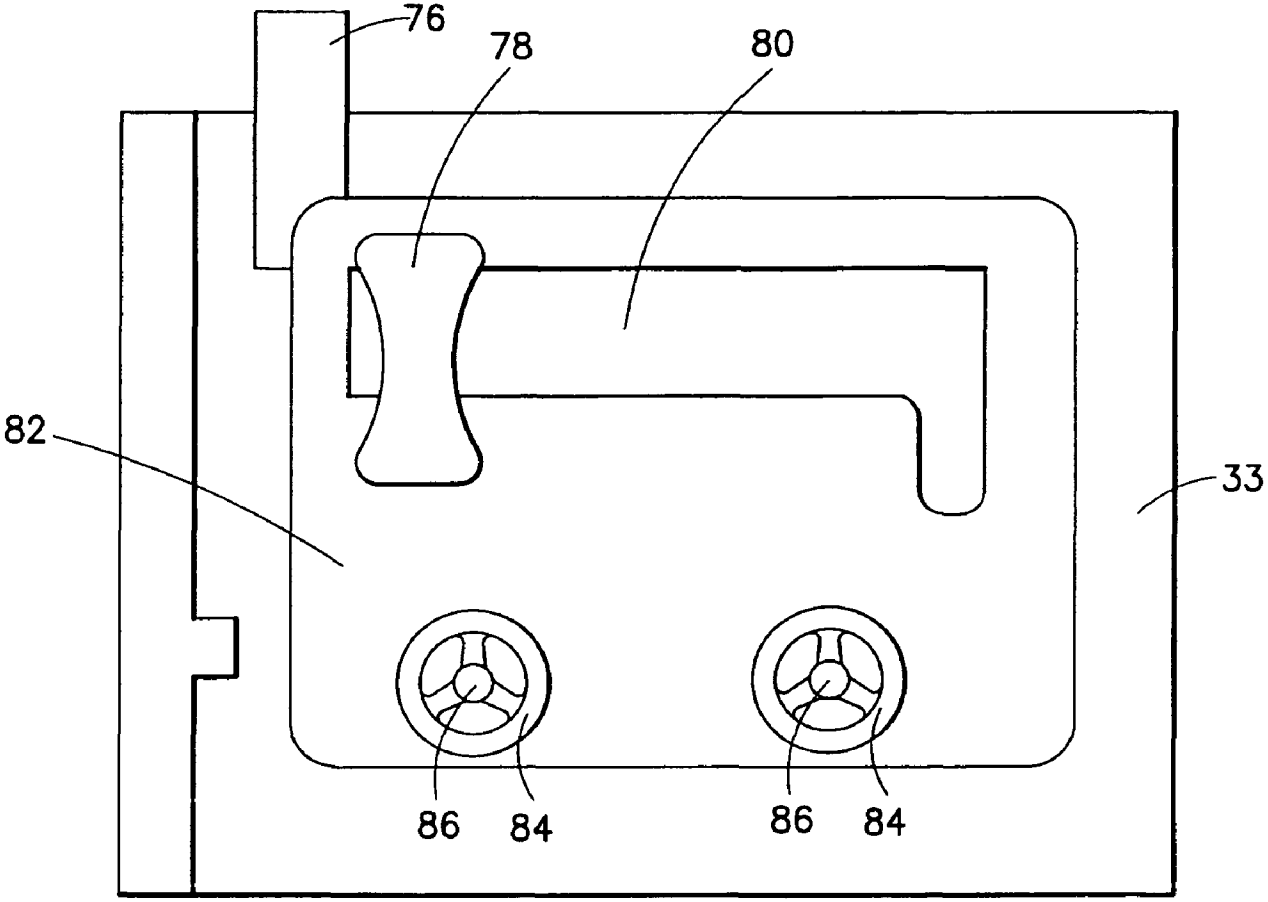
FIGS. 9A-9C show an example embodiment of an adjustable slip stop for the validation slot mounted on the inside of a pen cover in accordance with the present invention. Each
Figure 9B:
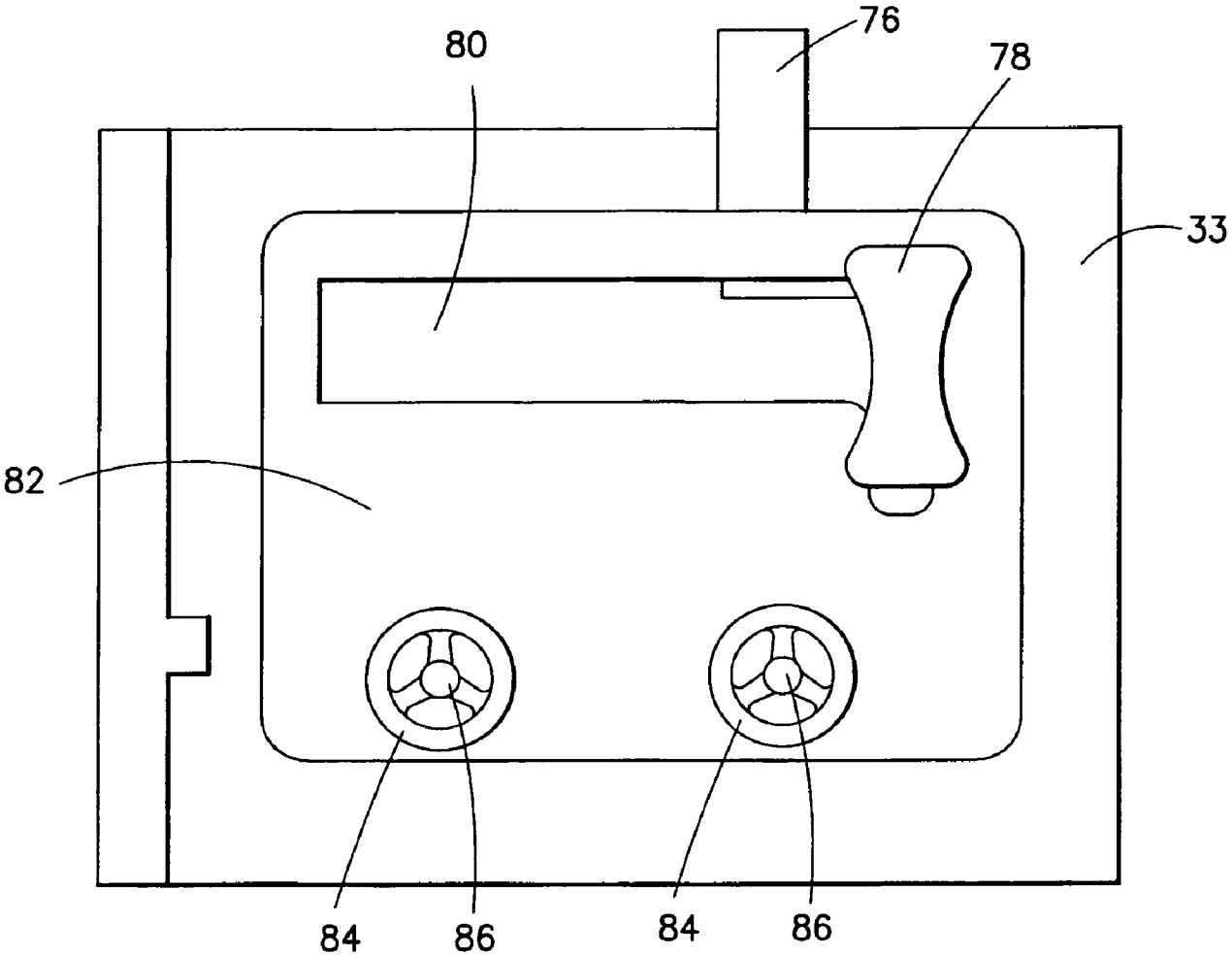
Figure 9C:
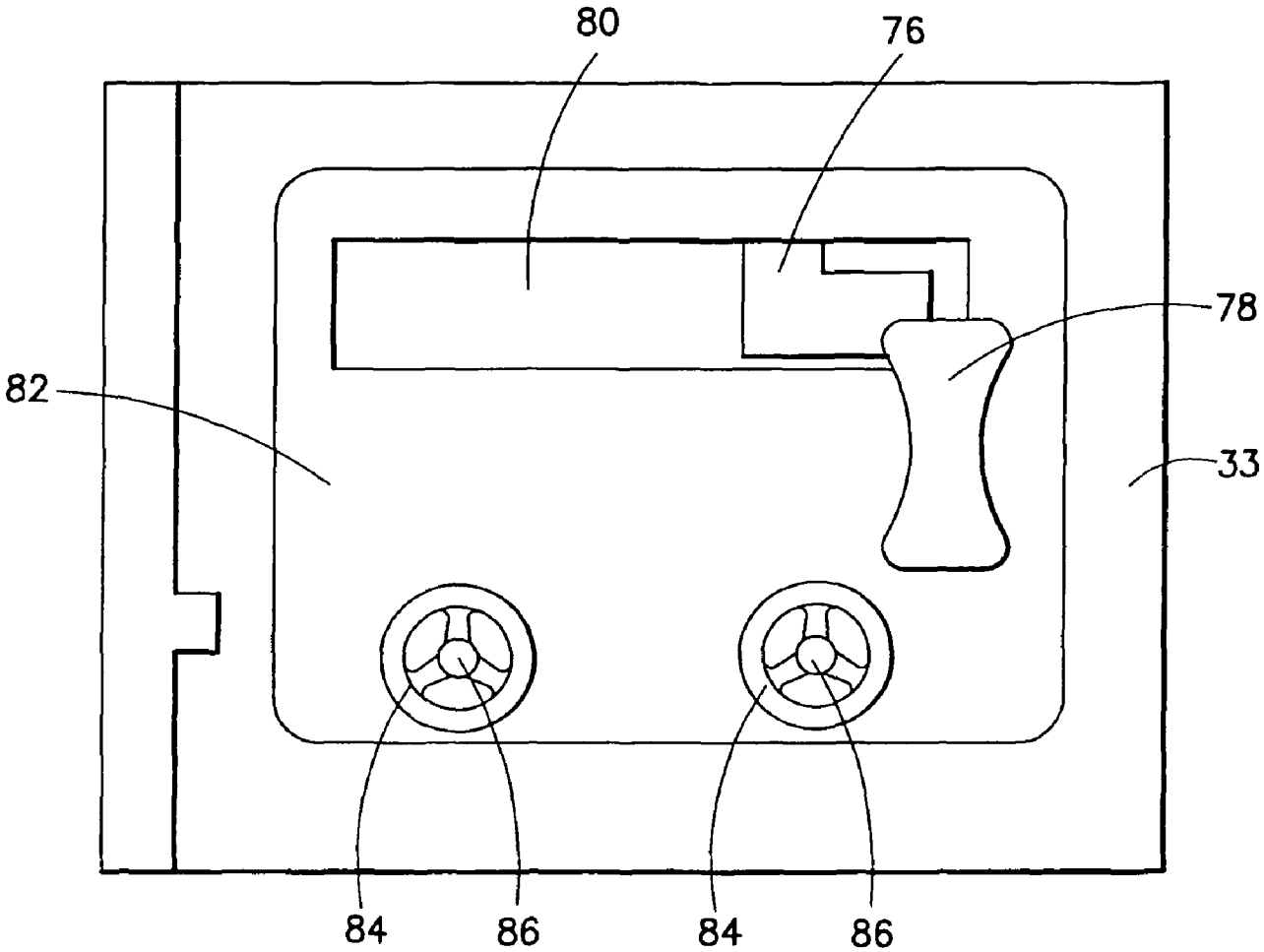

As shown in FIGS. 9A-9C, an adjustable slip stop 76 may be provided for variable positioning of the form in a validation slot 72 (FIG. 3) of the validation path 20. The slip stop 76 may be mounted on a spring plate 82 affixed to the underside 33 of pen cover 32 just to the right of the print zone. The plate 82 may be affixed to the pen cover using retaining clips 84 that are pushed onto posts 86 extending from the pen cover 32 that protrude through holes (not shown) in the plate 82. The pen cover 32 pivots open from the lower front position (in the same manner as the receipt cover 30 pivots open from the lower rear position as discussed above).

The slip stop 76 can be extended into the validation path 20, as shown in FIGS. 9A and 9B. This creates a repeatable print position for multiple validations. The operator may position the form adjacent to the slip stop 76 to provide a registration stop for the form to be validated. The slip stop 76 may be provided on one side of the print zone. In FIGS. 9A-9C, the slip stop is shown positioned on the right side of the print zone. Those skilled in the art will appreciate that the slip stop 76 may just as easily be positioned on the left side of the print zone. The position of the slip stop 76 may be adjustable. A knob or handle 78 may be provided for adjusting the slip stop 76. For example, the slip stop 76 may be moved to the left in slot 80 (i.e., slid further into the print zone) as shown in FIG. 9A or to the right in slot 80 (i.e., moved to the edge of the print zone) as shown in FIG. 9B. When moved to the left and into the print zone as shown in FIG. 9A, the slip stop 76 may create a very small print margin. When slid to the right and to the edge of the print zone as shown in FIG. 9B, the slip stop 76 may create approximately a 1" print margin. The slip stop 76 may also be positioned at any point in the slot 80. Indents (not shown) may be provided along the top or bottom of the slot 80 to provide defined stopping positions along the slot at predefined intervals (e.g., every ¼ or ⅛ of an inch, or the like). The slip stop 76 may be retractable, enabling the slip stop 76 to be moved into and out of the validation slot and the validation path. FIG. 9C shows the slip stop 76 in a retracted position out of the validation slot 72. Retraction of the slip stop 76 as shown in FIG. 9C allows "Cut Through Validation" (i.e. full adjustment of form position within the print zone.)

It should now be appreciated that the present invention provides advantageous methods and apparatus for both printing receipts and validating forms using a single compact, low-cost printer.

Although the invention has been described in connection with various illustrated embodiments, numerous modifications and adaptations may be made thereto without departing from the spirit and scope of the invention as set forth in the claims.

What is claimed is:

1. Dual-purpose printer for printing receipts and validating forms, comprising:

a receipt drive roller for driving paper through a receipt path;

a dual-purpose roller capable of contacting the drive roller, said receipt path formed between the receipt drive roller and the dual-purpose roller;

a validation idler roller adapted to be brought into and out of engagement with said dual-purpose roller;

a print station, said validation idler roller being mounted in said print station;

a validation lift assembly for moving said print station between an open and a closed position; and a validation path formed between said validation idler roller and said dual-purpose roller;

wherein:

a rotation of said receipt drive roller in a first direction enables driving of said paper through said receipt path;

when said validation idler roller is in engagement with said dual-purpose roller, a rotation of the dual-purpose roller in said first direction enables discharging of a form from said validation path when validation is completed;

in said open position said validation idler roller is out of engagement with said dual-purpose roller; and in said closed position said validation idler roller is in engagement with said dual-purpose roller.

2. A dual-purpose printer in accordance with claim 1, further comprising a receipt cover, wherein the receipt drive roller pivots with the receipt cover.

3. A dual-purpose printer in accordance with claim 2, further comprising a receipt drive frame affixed to said cover.

4. A dual-purpose printer in accordance with claim 3, wherein the receipt drive roller is arranged in the receipt drive frame.

5. A dual-purpose printer in accordance with claim 3, further comprising at least one gear train for driving said receipt drive roller on at least one corresponding side of said receipt drive frame.

6. A dual-purpose printer in accordance with claim 3, further comprising duplicate gear trains for driving said receipt drive roller on opposing sides of said receipt drive frame.

7. A dual-purpose printer in accordance with claim 1, wherein said dual-purpose roller comprises:

a center idler segment which opposes a center drive segment of the receipt drive roller; and two outer drive segments on either side of said center idler segment.

8. A dual-purpose printer in accordance with claim 7, wherein:

said center idler segment is adapted to idle against said receipt drive roller when in contact with said receipt drive roller; and said outer drive segments engage corresponding segments of said validation idler roller when said validation idler roller is brought into engagement with said dual-purpose roller.

9. A dual-purpose printer in accordance with claim 1, wherein said form comprises one of a check, a voucher, a ticket, and a coupon.

10. A dual-purpose printer in accordance with claim 1, further comprising:

a validation slot in said validation paper path for accepting said form;

wherein said validation slot extends through a body of said printer enabling validation of forms that are larger than a width of said printer.

11. A dual-purpose printer in accordance with claim 10, further comprising:

an adjustable slip stop for variable positioning of said form in said validation slot.

12. A dual-purpose printer in accordance with claim 1, further comprising at least one gear train for driving said dual-purpose roller.

13. A dual-purpose printer in accordance with claim 1, further comprising separate drive motors for said receipt drive roller and said dual-purpose roller.

14. Dual-purpose printer for printing receipts and validating forms, comprising:

a receipt drive roller for driving paper through a receipt path;

a dual-purpose roller capable of contacting the drive roller, said receipt path formed between the receipt drive roller and the dual-purpose roller;

a validation idler roller adapted to be brought into and out of engagement with said dual-purpose roller;

a validation path formed between said validation idler roller and said dual-purpose roller;

a receipt cover; and a receipt drive frame affixed to the receipt cover, the receipt drive roller being arranged in said receipt drive frame and adapted to pivot with the receipt cover;

wherein:

a rotation of said receipt drive roller in a first direction enables driving of said paper through said receipt path;

when said validation idler roller is in engagement with said dual-purpose roller, a rotation of the dual-purpose roller in said first direction enables discharging of a form from said validation path when validation is completed; and said receipt drive frame permits movement of the receipt drive roller in a radial arc about a pitch line of a corresponding drive gear.

15. A dual-purpose printer in accordance with claim 14, further comprising a print station.

16. A dual-purpose printer in accordance with claim 15, wherein said validation idler roller is mounted in said print station.

17. A dual-purpose printer in accordance with claim 16, further comprising a print carriage mounted to said print station.

18. A dual-purpose printer in accordance with claim 15, wherein said validation idler roller is mounted in slide bearings in said print station.

19. Dual-purpose printer for printing receipts and validating forms, comprising:

a receipt drive roller for driving paper through a receipt path;

a dual-purpose roller capable of contacting the drive roller, said receipt path formed between the receipt drive roller and the dual-purpose roller;

a validation idler roller adapted to be brought into and out of engagement with said dual-purpose roller;

a print station, said validation idler roller being mounted in said print station; and a validation path formed between said validation idler roller and said dual-purpose roller;

wherein:

a rotation of said receipt drive roller in a first direction enables driving of said paper through said receipt path;

when said validation idler roller is in engagement with said dual-purpose roller, a rotation of the dual-purpose roller in said first direction enables discharging of a form from said validation path when validation is completed; and said print station is adapted for pivotable movement enabling said validation idler roller to be brought into and out of engagement with said dual-purpose roller.

20. A dual-purpose printer in accordance with claim 19, further comprising a validation lift assembly for moving said print station between an open and a closed position, wherein:

in said open position said validation idler roller is out of engagement with said dual-purpose roller; and in said closed position said validation idler roller is in engagement with said dual-purpose roller.

21. A dual-purpose printer in accordance with claim 20, further comprising at least one sensor for sensing said open and said closed positions.

22. A dual-purpose printer in accordance with claim 20, wherein:

said validation lift assembly comprises a compact DC motor, a worm gear reduction unit, and a disk cam; and said disk cam engages an underside of the print station.

23. A dual-purpose printer in accordance with claim 22, wherein an upper surface of said cam is profiled for pivoting said print station between said open position and said closed position.

24. Dual-purpose printer for printing receipts and validating forms, comprising:

a receipt drive roller for driving paper through a receipt path;

a dual-purpose roller capable of contacting the drive roller, said receipt path formed between the receipt drive roller and the dual-purpose roller;

a validation idler roller adapted to be brought into and out of engagement with said dual-purpose roller;

a validation path formed between said validation idler roller and said dual-purpose roller;

a validation slot in said validation paper path for accepting a form, said validation slot extending through a body of said printer enabling validation of forms that are larger than a width of said printer; and an adjustable slip stop for variable positioning of said form arranged in said validation slot;

wherein:

a rotation of said receipt drive roller in a first direction enables driving of said paper through said receipt path;

when said validation idler roller is in engagement with said dual-purpose roller, a rotation of the dual-purpose roller in said first direction enables discharging of said form from said validation path when validation is completed; and said slip stop is retractable, enabling said slip stop to be moved into and out of said validation slot and said validation path.

25. A method for printing receipts and validating forms, comprising:

providing a receipt path between a receipt drive roller and a dual-purpose roller;

providing a validation path between a validation idler roller and said dual-purpose roller;

providing a print station, said validation idler roller being mounted in said print station;

enabling the receipt drive roller to rotate in a first direction for driving of paper through the receipt path;

enabling said validation idler roller to be brought into and out of engagement with said dual-purpose roller; and enabling the dual-purpose roller to rotate in said first direction when said validation idler roller is brought into engagement with the dual-purpose roller for driving a form out of said validation path after validation is complete;

wherein said print station is adapted for pivotable movement enabling said validation idler roller to be brought into and out of engagement with said dual-purpose roller.

* * * * *